US007353836B2

(12) United States Patent
Lee-Liao

(10) Patent No.: US 7,353,836 B2
(45) Date of Patent: Apr. 8, 2008

(54) DEVICE FOR PURGING DEPOSIT FROM AN ENGINE

(76) Inventor: Man Lee-Liao, No. 432, Chang Ping East 5th Road, Pei Tun District, Taichung (TW)

( * ) Notice: Subject to any disclaimer, the term of this patent is extended or adjusted under 35 U.S.C. 154(b) by 176 days.

(21) Appl. No.: 11/164,517

(22) Filed: Nov. 28, 2005

(65) Prior Publication Data

US 2007/0119502 A1 May 31, 2007

(51) Int. Cl.
*F04F 1/00* (2006.01)

(52) U.S. Cl. ..... 137/212; 137/240

(58) Field of Classification Search ..... 137/212, 137/240; 222/400.7

See application file for complete search history.

(56) References Cited

U.S. PATENT DOCUMENTS 5,535,923 A * 7/1996 Fujioka ..... 137/240

7,051,752 B2 * 5/2006 Fiebig ..... 137/212

OTHER PUBLICATIONS

Taiwanese Patent Publication No. 482251, Apr. 1, 2002, 6 pages.

* cited by examiner

*Primary Examiner*—Kevin Lee
(74) *Attorney, Agent, or Firm*—Alan Kamrth; Kamrath & Associates PA

(57) ABSTRACT

There is disclosed a device for purging filth from an engine. The device includes a closing element for closing a tank. The closing element defines a first channel through which a purging agent goes to the engine from the tank and a second channel through which pressurized air goes to the tank from a source. A single-channel joint defines a channel in communication with the second channel of the closing element. A pressure regulation set is in communication with the channel of the single-channel joint. A bi-channel joint defines a first channel in communication with the pressure regulation set and a second channel in communication with the first channel perpendicularly. A release valve is in communication with the second channel of the bi-channel joint. A check valve is installed in the first channel of the bi-channel joint.

11 Claims, 7 Drawing Sheets

DEVICE FOR PURGING DEPOSIT FROM AN ENGINE

BACKGROUND OF INVENTION

1. Field of Invention

The present invention relates to an engine and, more particularly, to a device for purging deposit from an engine.

2. Related Prior Art

Disclosed in Taiwanese Patent Publication No. 482251 is a device for purging deposit from an engine. The device includes a tank 20 for storing a purging agent and pressurized air, a closing element 30 for closing the tank 20, a check valve 60 for permitting the pressurized air into the tank 20 through the closing element 30 but not vice versa, a pressure regulator 80 for regulating the pressure of the pressurized air through the check valve 60, a joint 90 for communicating the pressure regulator 80 with an external source of the pressurized air, a release valve 70 for releasing an excessive amount of the pressurized air from the tank 20 through the closing element 30, and a joint 50 for communicating the closing element 30 with a pipe that can be connected to an engine. The closing element 30 defines an intake channel 33, a release channel 34 and an outlet channel 35. The intake channel 33 includes a horizontal section and a vertical section. The check valve 60 is inserted partially in the horizontal section of the intake channel 33. The release channel 34 is in communication with the vertical section of the intake channel 33 in a slant manner as shown in FIGS. 5 and 6 of the Taiwanese patent. It is difficult to make the release channel 34 in the closing element 30 in the slant manner. Moreover, it is difficult to install the release valve 70 on the closing element 30.

Therefore, the present invention is intended to obviate or at least alleviate the problems encountered in prior art.

SUMMARY OF INVENTION

According to the present invention, a device for purging filth from an engine includes a closing element for closing a tank. The closing element defines a first channel through which a purging agent goes to the engine from the tank and a second channel through which pressurized air goes to the tank from a source. A single-channel joint defines a channel in communication with the second channel of the closing element. A pressure regulation set is in communication with the channel of the single-channel joint. A bi-channel joint defines a first channel in communication with the pressure regulation set and a second channel in communication with the first channel perpendicularly. A release valve is in communication with the second channel of the bi-channel joint. A check valve is installed in the first channel of the bi-channel joint.

An advantage of the device of the present invention is the easy making of the second channel in the bi-channel joint in a radial direction.

Another advantage of the device of the present invention is the easy connection of both of the release valve and the check valve to the joint.

Still another advantage of the device of the present invention is its practical and inexpensive mass-production.

Still another advantage of the device of the present invention is its easy operation.

Other advantages and features of the present invention will become apparent from the following description referring to the drawings.

BRIEF DESCRIPTION OF DRAWINGS

The present invention will be described in detail through illustrating two embodiments referring to the drawings.

DETAILED DESCRIPTION OF EMBODIMENTS

Figure 1:
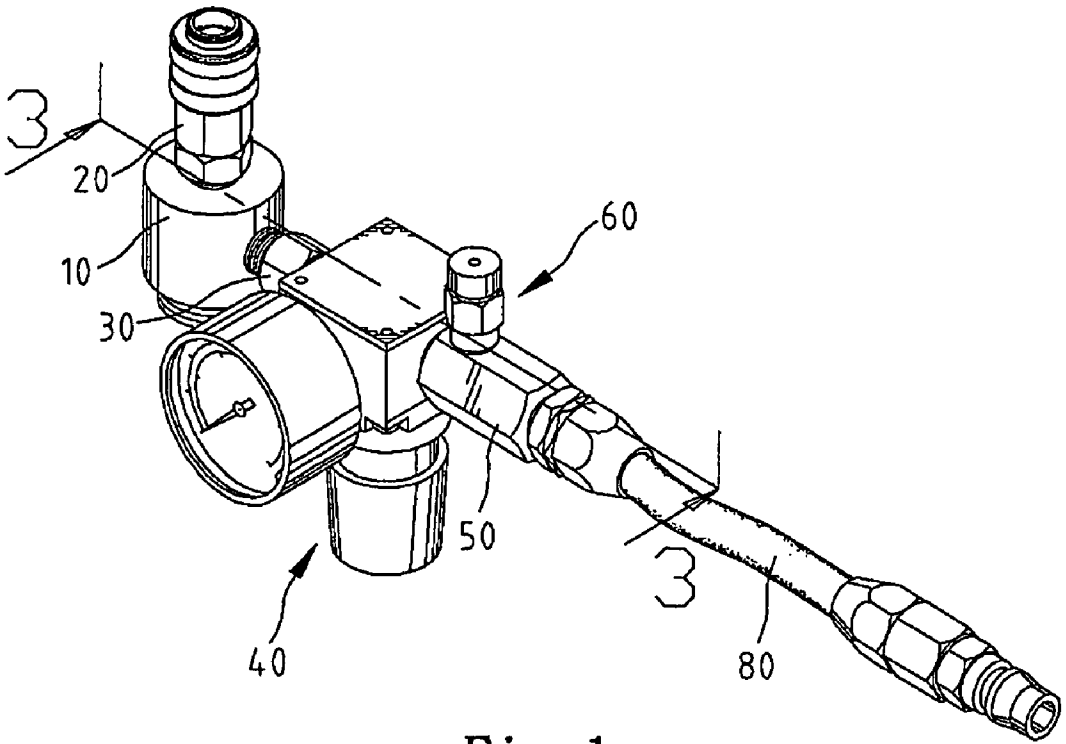
FIG. 1 is a perspective view of a device for purging deposit from an engine according to the first embodiment of the present invention.
Figure 2:
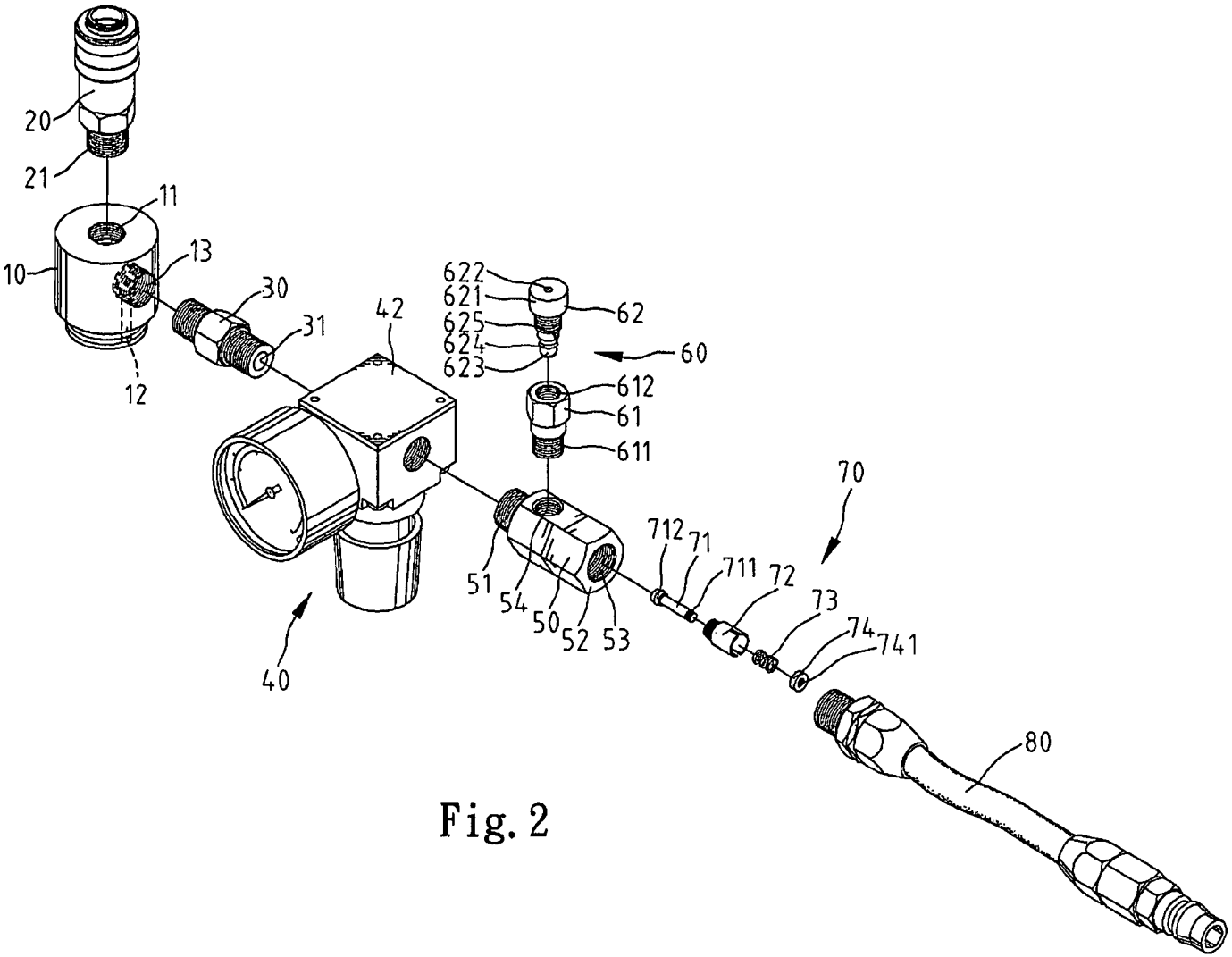
FIG. 2 is an exploded view of the device shown in FIG. 1.

Referring to FIGS. 1 through 4, there is shown a device for purging deposit from an engine according to a first embodiment of the present invention. The device is installed on a tank 90 that is used to receive and store a purging agent and pressurized air through the device.

The device includes a closing element 10 for closing the tank 90, a joint 20, a joint 30 in communication with the closing element 10, a pressure regulation set 40 for regulating the pressure of the pressurized air through the joint 30, a joint 50 in communication with the pressure regulation set 40, a release valve 60 for releasing an excessive amount of the pressurized air from the tank 90 through the joint 50, a check valve 70 for permitting the pressurized air into the tank 90 through the joint 50 but not vice versa, and a pipe 80 for communicating the joint 50 to an external source of the pressurized air.

The closing element 10 includes a cylindrical configuration. The closing element 10 may be a plug with a thread formed on the exterior as shown or a cap with a thread formed on the interior. The closing element 10 defines an axial channel 11, a longitudinal channel 12 parallel to the axial channel 11 and a transverse channel 13 in communication with the longitudinal channel 12. A thread is formed on the wall of the axial channel 11. A thread is formed on the wall of the transverse channel 13.

The joint 20 is formed with a thread 21 for engagement with the thread formed on the wall of the axial channel 11 in order to connect the joint 20 to the closing element 10.

The joint 30 defines an axial channel 31. The joint 30 includes a first thread formed on an end and a second thread formed on an opposite end. The first thread of the joint 30 is for engagement with the thread formed on the wall of the transverse channel 13 in order to connect the joint 30 to the closing element 10.

The pressure regulation set 40 consists of a pressure regulator 42 and a pressure gauge 44. The pressure regulator 42 defines a channel. The pressure regulator 42 includes a first thread formed on the wall of the channel and a second thread formed on the wall of the channel. The first thread of the pressure regulator 42 is for engagement with the second thread of the joint 30 in order to connect the pressure regulator 42 to the joint 30.

The joint 50 defines an axial channel 53 and a transverse channel 54 in communication with the axial channel 53. The joint 50 includes a first section 51 and a second section 52 with a larger diameter than that of the first section 51. A thread is formed on the exterior of the first section 51. Another thread is formed on the interior of the second section 52, i.e., on the wall of the axial channel 53. Another thread is formed on the wall of the transverse channel 54. The thread formed on the exterior of the first section 51 of the joint 50 is for engagement with the second thread of the pressure regulator in order to connect the joint 50 to the pressure regulator 42.

The release valve 60 includes a housing 61 and a core 62 movable in the housing 61. The housing 61 includes a first section 611 and a second section 612. A thread is formed on the exterior of the first section 611. Another thread is formed on the interior of the second section 612. The thread formed on the exterior of the first section 611 of the housing 61 is for engagement with the thread formed on the wall of the transverse channel 54 of the joint 50 in order to connect the housing 61 to the joint 50.

The core 62 defines an axial channel 622 and a transverse channel 625 in communication with the axial channel 622. The core 62 includes a head 621 and a tail 623. A seal 624 is provided around the tail 623. Formed on the exterior of the tail 623 is a thread for engagement with the thread formed on the interior of the second section 612 of the housing 611 in order to connect the core 62 to the housing 61.

The check valve 70 included a core 71, a housing 72, a spring 73 and a nut 74. The core 71 includes a head and a tail with a diameter smaller than that of the head. A thread is formed on the tail of the core 71. A seal 712 is provided around the head of the core 71. The core 71 is movable in the axial channel 53 of the joint 50.

The interior of the housing 72 includes a narrow section and a wide section with an internal diameter larger than that of the narrow section, thus forming a shoulder between the narrow and wide sections. Formed on the exterior of the housing 72 is a thread for engagement with a thread formed on the interior of the joint 50 in order to connect the housing 72 to the joint 50.

The head of the core 71 is positioned outside the housing 72 while the tail of the core 71 is positioned in the housing 72. The spring 73 is provided around the tail of the core 71 in the wide section of the interior of the housing 72. The thread of the nut 74 is for engagement with the thread of the core 71. The spring 73 is compressed between the nut 74 and the shoulder of the interior of the housing 72. The seal 712 tends to abut the housing 72 due to the use of the spring 73.

Figure 3:
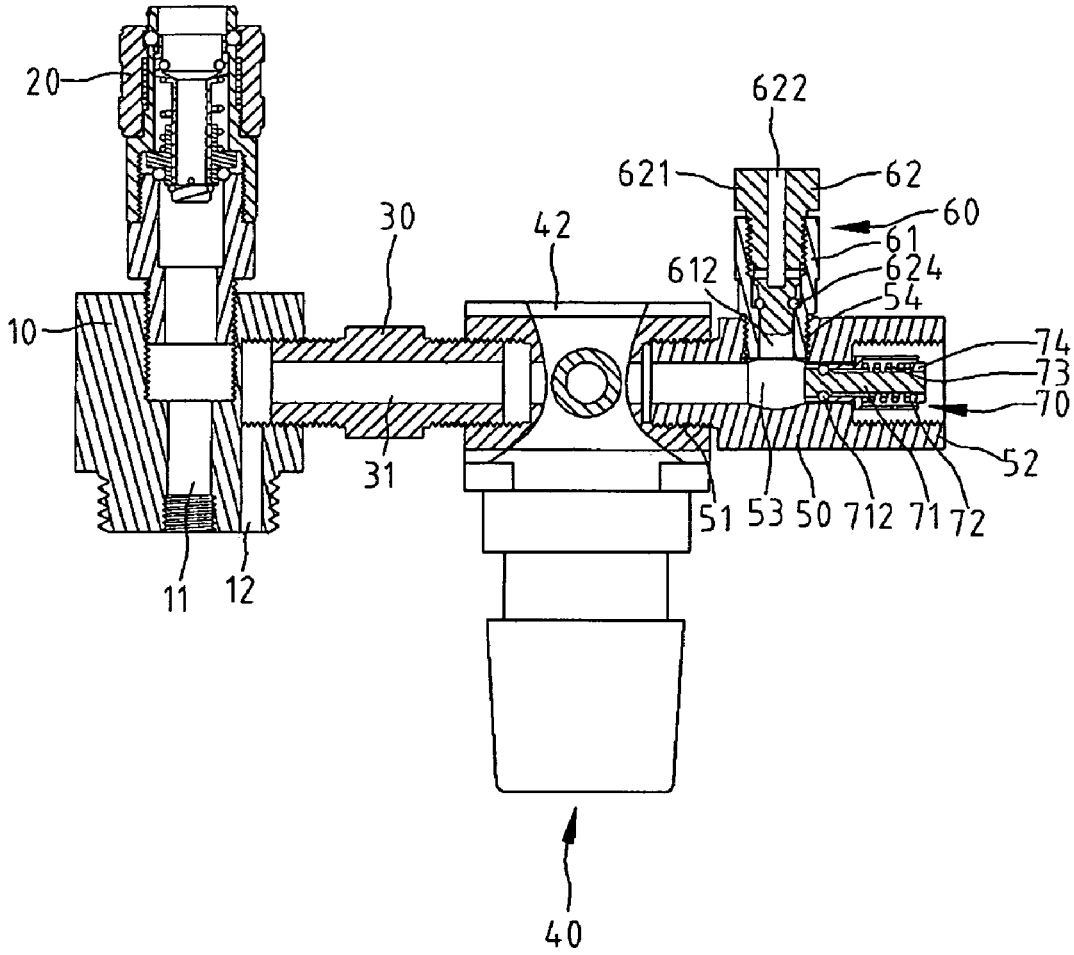
FIG. 3 is a cross-sectional view of the device taken along a line 3-3 in FIG. 1, with a joint removed.

Referring to FIG. 3, the joint 80 is not connected to the joint 50. The seal 712 abuts the housing 72. The pressurized air cannot go to the exterior of the device through the check valve 70.

Figure 4:
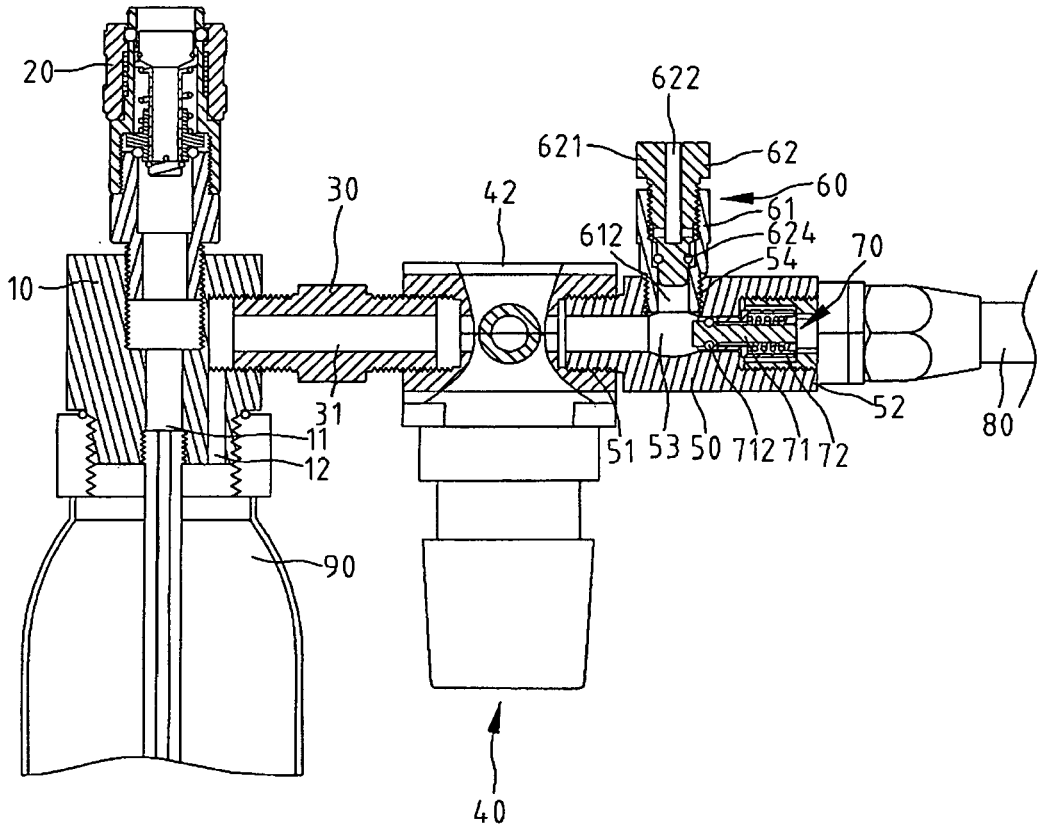
FIG. 4 is similar to FIG. 3 but shows the joint installed.

Referring to FIG. 4, the joint 80 is connected to the joint 50. The joint 80 pushes the core 71 through the nut 74. Now, the seal 712 leaves the housing 72. The pressurized air can go in the device through the check valve 70.

Figure 5:
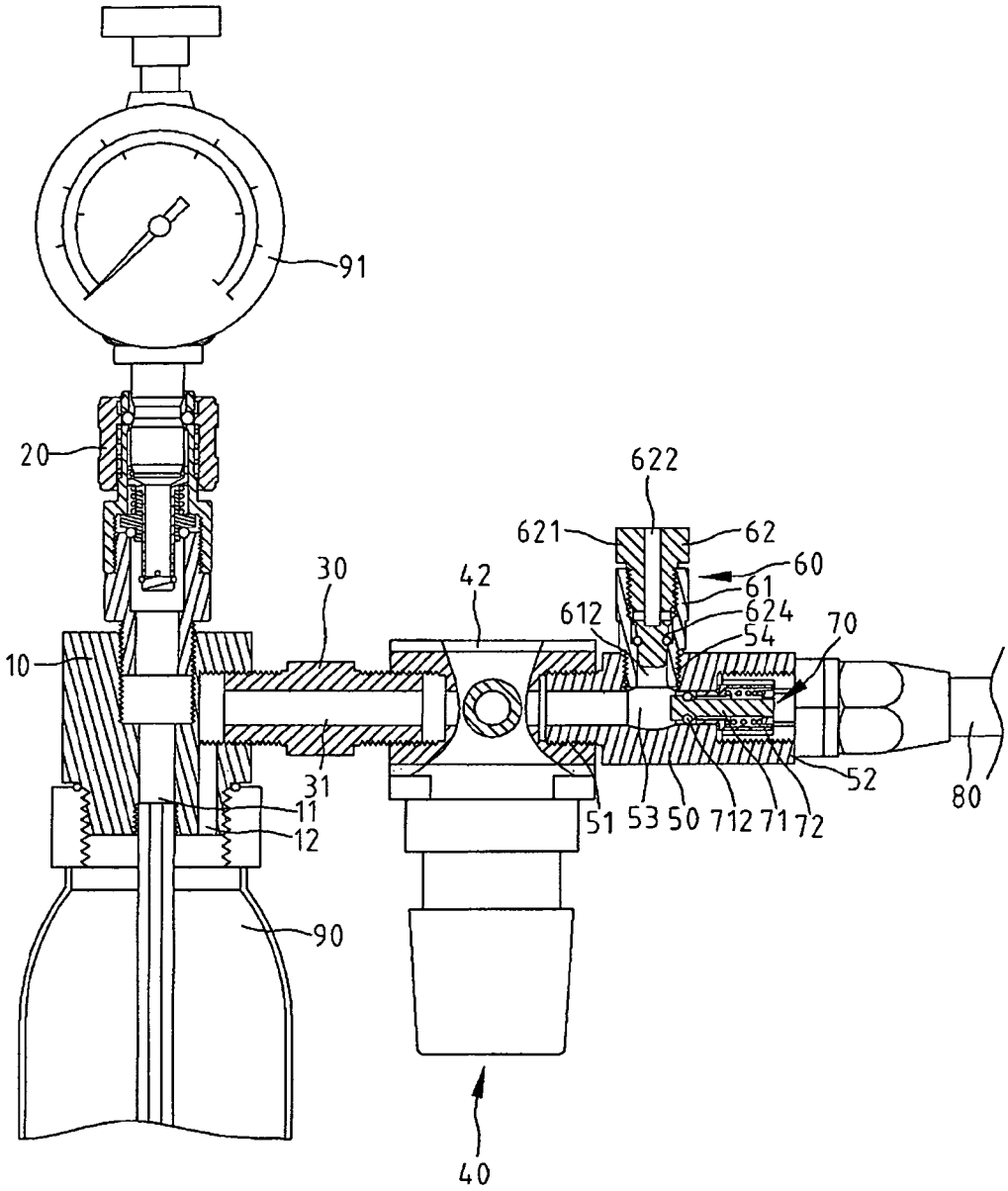
FIG. 5 is a cross-sectional view of the device in another position than shown in FIG. 4.
Figure 6:
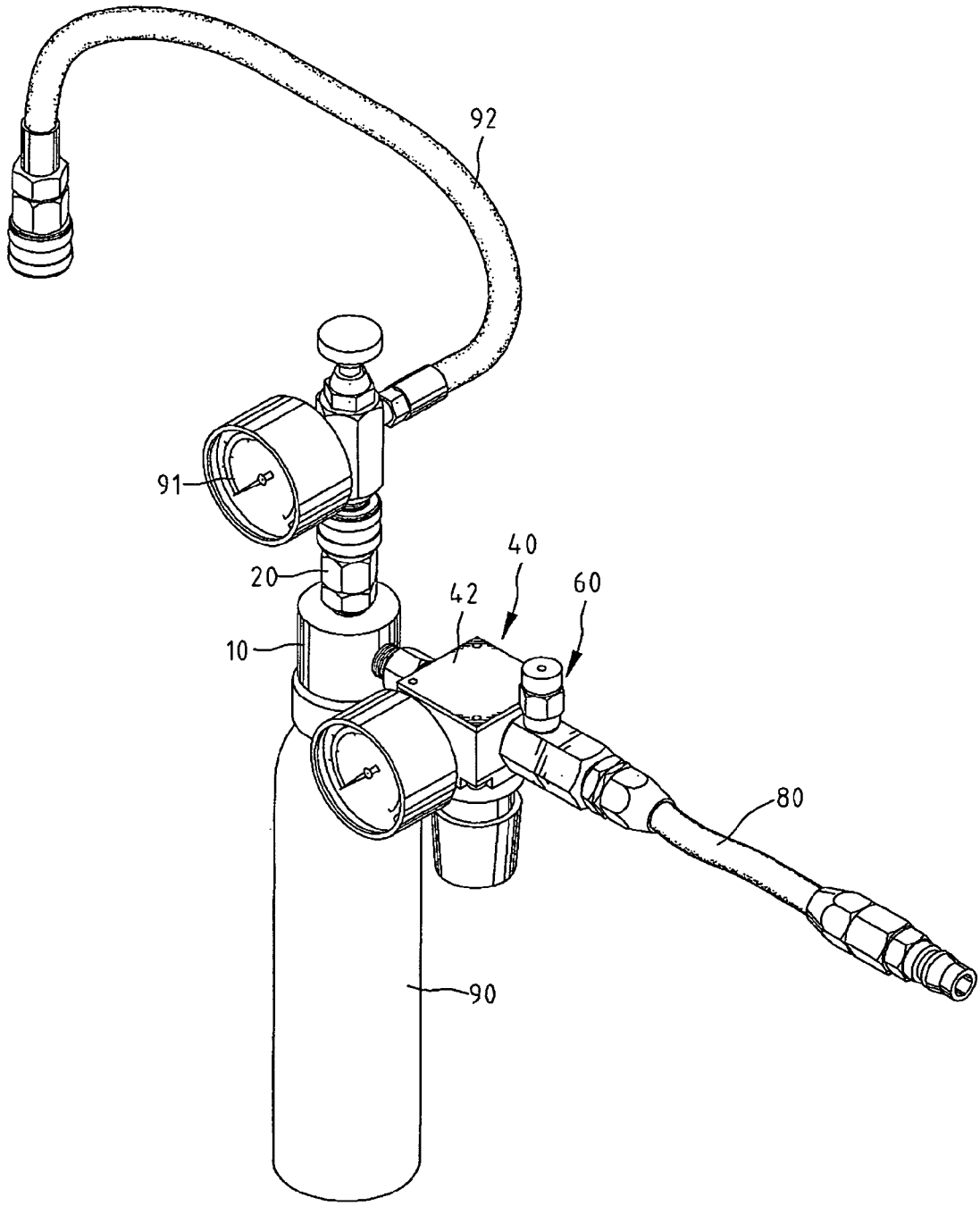
FIG. 6 is a perspective view of a device for purging deposit from an engine according to the second embodiment of the present invention.

Referring to FIGS. 5 and 6, a pressure gauge 91 and a pipe 92 are connected to the joint 20. The pressure regulation set 40 is turned on in order to allow the pressurized air to go into the tank 90 from the external source of the pressurized air through the device. The pressure rises in the thank 90. When the pressure reaches a pre-determined value in the tank 90, the pressure regulation set 40 is turned off. The pressurized air can carry the purging agent into the engine from the tank 90 in order to purge the deposit from the engine. After the purging operation, there may be a residual amount of the purging agent in the tank 90. The release valve 60 can be turned on in order to release the residual amount of the purging agent from the tank 90. The residual amount of the purging agent goes through the release valve 60 at a low pace, thus avoiding danger that might otherwise occur.

Figure 7:
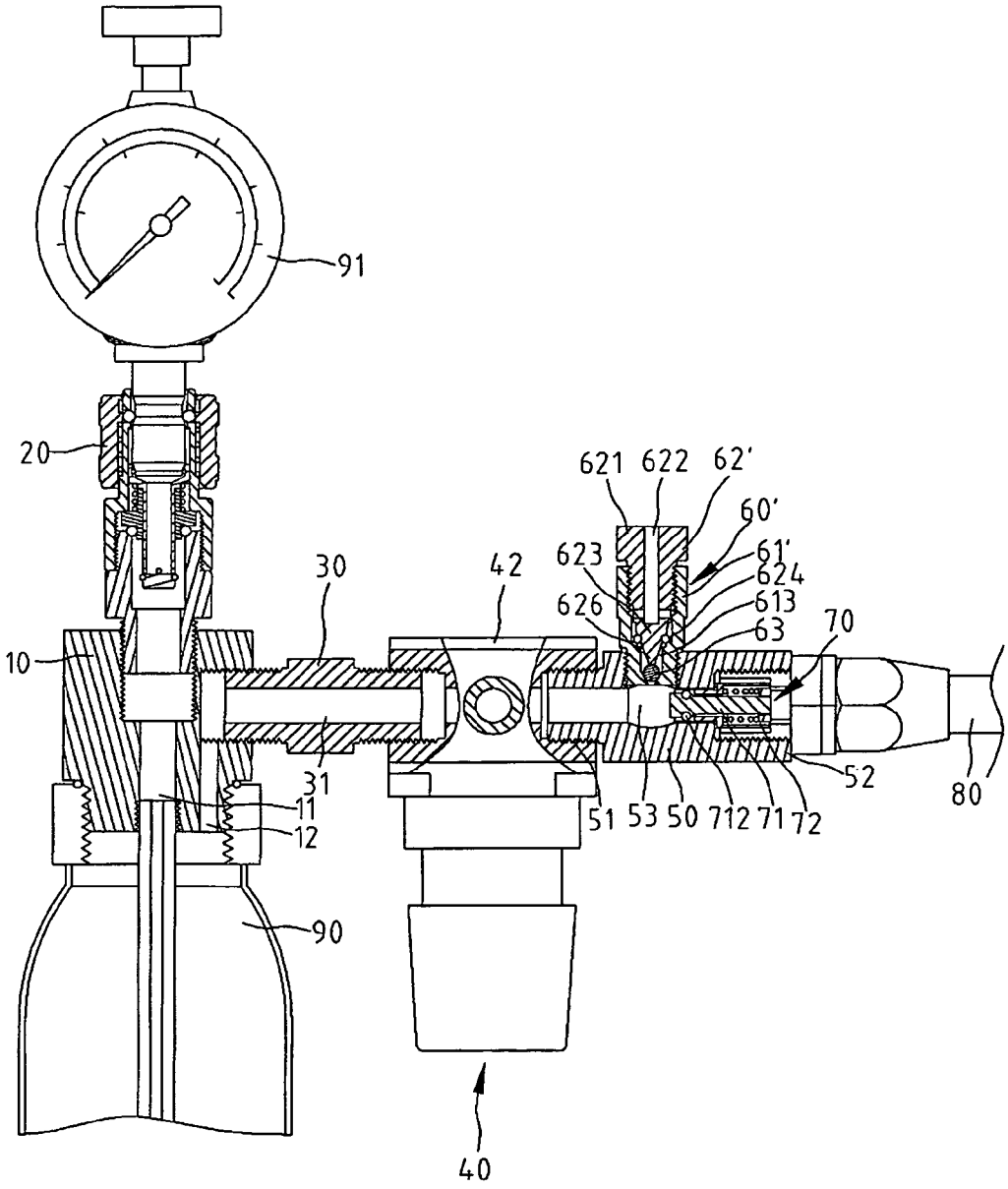
FIG. 7 is a cross-sectional view of the device shown in FIG. 6.

Referring to FIG. 7, there is shown a device for purging deposit from an engine according to a second embodiment of the present invention. The second embodiment is identical to the first embodiment except using a release valve 60' instead of the release valve 60. The release valve 60' includes a housing 61' and a core 62'. The housing 61' is identical to the housing 61 except that the interior of the housing 61' includes a taper section 613. The core 62' is identical to the core 62 except that the tail 623 includes a taper end 626. A ball 63 is positioned between the taper section 613 of the interior of the housing 61' and the taper end 626 of the tail 623 of the core 62'. Thus, an excellent sealing effect is achieved.

The device for purging deposit from an engine according to the present invention exhibits several advantages.

Firstly, it is easy to make the transverse channel 54 in the joint 50 in a radial direction.

Secondly, it is easy to connect both of the release valve 60 and the check valve 70 to the joint 50.

Thirdly, its mass-production is practical and inexpensive.

Fourthly, its operation is easy.

The present invention has been described through the illustration of the embodiments. Those skilled in the art can derive variations from the embodiments without departing from the scope of the present invention. Therefore, the embodiments shall not limit the scope of the present invention defined in the claims.

What is claimed is:

1. A device for purging filth from an engine, the device comprising:

a closing element for closing a tank, the closing element defining a first channel through which a purging agent goes to the engine from the tank and a second channel through which pressurized air goes to the tank from a source;

a single-channel joint defines a channel in communication with the second channel of the closing element;

a pressure regulation set in communication with the channel of the single-channel joint;

a bi-channel joint defining a first channel in communication with the pressure regulation set and a second channel in communication with the first channel perpendicularly;

a release valve in communication with the second channel of the bi-channel joint; and a check valve installed in the first channel of the bi-channel joint.

2. The device according to claim 1 wherein the first and second channels of the closing element are parallel to each other.

3. The device according to claim 2 wherein the closing element further defines a third channel in communication with the second channel thereof perpendicularly, wherein the third channel of the closing element is in communication with the channel of the single-channel joint.

4. The device according to claim 1 wherein the release valve comprises a housing and a core movable in the housing.

5. The device according to claim 4 wherein the release valve further comprises a ball between the interior of the housing and the core.

6. The device according to claim 5 wherein the interior of the housing comprises a taper section for receiving the ball, wherein the core comprises a taper end for abutting the ball.

7. The device according to claim 4 wherein the core defines a first channel and a second channel in communication with the first channel.

8. The device according to claim 4 wherein the release valve further comprises a seal provided around the core for sealing contact with the interior of the housing.

9. The device according to claim 1 wherein the check valve comprises a housing and a core comprising a first section for sealing contact with the housing on the outside and a reduced second section movable in the housing.

10. The device according to claim 9 wherein the check valve further comprises a seal around the first section of the core.

11. The device according to claim 9 wherein the check valve further comprises a nut on the second section of the core and a spring between the nut and the housing thereof.

* * * * *